US008235149B2

(12) United States Patent
Lockstedt et al.

(10) Patent No.: US 8,235,149 B2
(45) **Date of Patent: *Aug. 7, 2012**

(54) DIAMOND BIT STEEL BODY CUTTER POCKET PROTECTION

(75) Inventors: Alan W. Lockstedt, Magnolia, TX (US); Thomas W. Oldham, The Woodlands, TX (US)

(73) Assignee: Smith International, Inc., Houston, TX (US)

( * ) Notice: Subject to any disclaimer, the term of this patent is extended or adjusted under 35 U.S.C. 154(b) by 203 days.

This patent is subject to a terminal disclaimer.

(21) Appl. No.: 12/650,162

(22) Filed: Dec. 30, 2009

(65) Prior Publication Data

US 2010/0101869 A1 Apr. 29, 2010

Related U.S. Application Data

(63) Continuation of application No. 11/511,881, filed on Aug. 29, 2006, now Pat. No. 7,644,786.

(51) Int. Cl.
*E21B 10/55* (2006.01)

(52) U.S. Cl. ..... 175/432

(58) Field of Classification Search ..... 175/432, 175/428, 426

See application file for complete search history.

(56) References Cited

U.S. PATENT DOCUMENTS

| | | | | |
|---|---|---|---|---|
| 4,836,307 | A * | 6/1989 | Keshavan et al. | 175/374 |
| 4,949,598 | A * | 8/1990 | Griffin | 76/108.2 |
| 5,007,493 | A * | 4/1991 | Coolidge et al. | 175/432 |
| 5,056,382 | A * | 10/1991 | Clench | 76/108.2 |
| 5,213,171 | A * | 5/1993 | Clench et al. | 175/420.1 |
| H1566 | H * | 8/1996 | Azar | 76/108.2 |
| 5,791,422 | A * | 8/1998 | Liang et al. | 175/374 |
| 5,921,330 | A * | 7/1999 | Sue et al. | 175/374 |
| 6,135,218 | A * | 10/2000 | Deane et al. | 175/425 |
| 6,328,117 | B1 * | 12/2001 | Berzas et al. | 175/57 |
| 6,568,491 | B1 * | 5/2003 | Matthews et al. | 175/374 |
| 6,651,756 | B1 * | 11/2003 | Costo et al. | 175/374 |
| 6,659,206 | B2 * | 12/2003 | Liang et al. | 175/374 |
| 6,772,849 | B2 * | 8/2004 | Oldham et al. | 175/433 |
| 7,644,786 | B2 * | 1/2010 | Lockstedt et al. | 175/432 |
| 2007/0056776 | A1 * | 3/2007 | Overstreet | 175/426 |
| 2007/0089913 | A1 * | 4/2007 | Desai et al. | 175/426 |
| 2007/0205023 | A1 * | 9/2007 | Hoffmaster et al. | 175/408 |

FOREIGN PATENT DOCUMENTS

| | | |
|---|---|---|
| GB | 2361018 | * 10/2001 |
| GB | 2369140 | * 5/2002 |
| GB | 2409474 | * 6/2005 |

OTHER PUBLICATIONS

Combined Search and Examination Report issued in GB Application No. 0716777.8 dated Jan. 11, 2008 (6 pages).*

Canadian Office Action issued in Application No. 2598143 dated May 28, 2009 (2 pages).*

* cited by examiner

*Primary Examiner* — Hoang Dang

(74) *Attorney, Agent, or Firm* — Osha • Liang LLP

(57) ABSTRACT

A drill bit that includes a steel bit body having at least one blade thereon, at least one cutter pocket disposed on the at least one blade; at least one cutter disposed in the at least one cutter pocket; at least one recess formed in at least a portion of the surface of the at least one cutter pocket, wherein the recess is adjacent a leading face of the at least one blade; and an erosion resistant material in the at least one recess is disclosed.

23 Claims, 4 Drawing Sheets

DIAMOND BIT STEEL BODY CUTTER POCKET PROTECTION

This application claims the benefit, pursuant to 35 U.S.C. §120, to U.S. patent application Ser. No. 11/511,881, filed on Aug. 29, 2006, which is herein incorporated by reference by its entirety.

BACKGROUND OF INVENTION

1. Field of the Invention

Embodiments disclosed herein relate generally to rotary drill bits used to drill well bores through the earth. More particularly, embodiments disclosed herein relate to steel-bodied drag bits.

2. Background Art

Rotary drill bits with no moving elements are typically referred to as "drag" bits. Drag bits are often used to drill a variety of rock formations. Drag bits include those having cutters (sometimes referred to as cutter elements, cutting elements or inserts) attached to the bit body. For example, the cutters may be formed having a substrate or support stud made of carbide, for example tungsten carbide, and an ultra hard cutting surface layer or "table" made of a polycrystalline diamond material or a polycrystalline boron nitride material deposited onto or otherwise bonded to the substrate at an interface surface.

An example of a prior art drag bit having a plurality of cutters with ultra hard working surfaces is shown in FIG. 1. The drill bit 10 includes a bit body 12 and a plurality of blades 14 that are formed on the bit body 12. The blades 14 are separated by channels or gaps 16 that enable drilling fluid to flow between and both clean and cool the blades 14 and cutters 18. Cutters 18 are held in the blades 14 at predetermined angular orientations and radial locations to present working surfaces 20 with a desired back rake angle against a formation to be drilled. Typically, the working surfaces 20 are generally perpendicular to the axis 19 and side surface 21 of a cylindrical cutter 18. Thus, the working surface 20 and the side surface 21 meet or intersect to form a circumferential cutting edge 22.

Orifices are typically formed in the drill bit body 12 and positioned in the gaps 16. The orifices are commonly adapted to accept nozzles 23. The orifices allow drilling fluid to be discharged through the bit in selected directions and at selected rates of flow between the cutting blades 14 for lubricating and cooling the drill bit 10, the blades 14 and the cutters 18. The drilling fluid also cleans and removes the cuttings as the drill bit rotates and penetrates the geological formation. The gaps 16, which may be referred to as "fluid courses," are positioned to provide additional flow channels for drilling fluid and to provide a passage for formation cuttings to travel past the drill bit 10 toward the surface of a wellbore (not shown).

The drill bit 10 includes a shank 24 and a crown 26. Shank 24 is typically formed of steel or a matrix material and includes a threaded pin 28 for attachment to a drill string. Crown 26 has a cutting face 30 and outer side surface 32. The particular materials used to form drill bit bodies are selected to provide adequate strength and toughness, while providing good resistance to abrasive and erosive wear.

The combined plurality of surfaces 20 of the cutters 18 effectively forms the cutting face of the drill bit 10. Once the crown 26 is formed, the cutters 18 are positioned in the cutter pockets 34 and affixed by any suitable method, such as brazing, adhesive, mechanical means such as interference fit, or the like. The design depicted provides the cutter pockets 34 inclined with respect to the surface of the crown 26. The cutter pockets 34 are inclined such that cutters 18 are oriented with the working face 20 at a desired rake angle in the direction of rotation of the bit 10, so as to enhance cutting. It will be understood that in an alternative construction (not shown), the cutters can each be substantially perpendicular to the surface of the crown, while an ultra hard surface is affixed to a substrate at an angle on a cutter body or a stud so that a desired rake angle is achieved at the working surface.

A typical cutter 18 is shown in FIG. 2. The typical cutter 18 has a cylindrical cemented carbide substrate body 38 having an end face or upper surface 54, which may also be referred to as the "interface surface." An ultra hard material layer (cutting layer) 44, such as polycrystalline diamond or polycrystalline cubic boron nitride layer, forms the working surface 20 and the cutting edge 22. A bottom surface 52 of the cutting layer 44 is bonded on to the upper surface 54 of the substrate 38. The joining surfaces 52 and 54 are herein referred to as the interface 46. The top exposed surface or working surface 20 of the cutting layer 44 is opposite the bottom surface 52. The cutting layer 44 typically has a flat or planar working surface 20, but may also have a curved exposed surface, that meets the side surface 21 at a cutting edge 22.

Bit bodies for drag bits may be selected from a matrix bit body and a steel bit body. Matrix bit bodies have good erosion and abrasion resistance, but the matrix material is relatively brittle which makes the matrix body susceptible to cracking and failure due to impact forces generated during drilling. While steel-bodied bits may have strength and toughness properties which make them resistant to cracking and failure due to impact forces generated during drilling, steel is more susceptible to erosive wear caused by high-velocity drilling fluids and formation fluids which carry abrasive particles, such as sand, rock cuttings, and the like. Thus, steel-bodied drag bits are generally coated with one or more "hard metals" such as metal oxides, metal nitrides, metal borides, metal carbides and alloys thereof to improve their erosion resistance. This erosion-resistant coating is commonly referred to as hardfacing.

The hard metal particles in the hardfacing are bonded to the steel bit body by a metal alloy ("binder alloy"), which is typically a nickel alloy. In effect, the hard metal particles are suspended in a matrix of nickel alloy forming a layer on the surface of the steel bit body. The hard metal particles give the hardfacing material hardness and wear resistance, while the matrix metal bonds the hard metal particles in place and provides some fracture toughness to the hardfacing.

A common mode of failure of steel-bodied bits is loss of cutters as the steel bit body is eroded away around the cutter. In order to solve this problem, hardfacing materials have been applied in the area surrounding the cutter pocket. However, erosion of the steel body around the cutters nonetheless may occur even when erosion-resistant hardfacing is applied in the area. The relatively thin coating of the hardfacing may crack, peel off or wear, exposing the softer steel body which is then rapidly eroded. Due to the high failure rates caused by the erosion undercutting of the steel body and poor coverage of hardfacing near and between the cutter pockets, a typical steel body bit generally achieves only one to two runs per bit.

Another method of preventing erosion of the steel around the cutters that can be used separately or in conjunction with a hardfacing involves the orientation of the orifices so that they spray drilling fluid directly at the earth formation rather than at the blades and/or cutters. The orifices may also be oriented so that they spray drilling fluid indirectly at the blades and/or cutters. However, this method of preventing erosion of the steel around the cutters is not satisfactory in many drilling applications due to the need to orient the spray of the drilling fluid more directly at the blade and cutters to prevent overheating of the cutters and other problematic phenomena such as bit balling.

Accordingly, there exists a need for a steel-bodied drag bit with greater bit body durability in the area surrounding the cutters, including greater erosion and abrasion resistance.

SUMMARY OF INVENTION

In one aspect, embodiments disclosed herein relate to a drill bit that includes a steel bit body having at least one blade thereon, at least one cutter pocket disposed on the at least one blade; at least one cutter disposed in the at least one cutter pocket; at least one recess formed in at least a portion of the surface of the at least one cutter pocket, wherein the recess is adjacent a leading face of the at least one blade; and an erosion resistant material in the at least one recess.

In another aspect, embodiments disclosed herein relate to a method of manufacturing a drill bit that includes forming a steel bit body having at least one blade and at least one cutter pocket; forming a recess in at least a portion of the surface of the at least one cutter pocket, wherein the recess is adjacent a leading face of the at least one blade; applying an erosion resistant material in the recess; and placing a cutter in the at least one cutter pocket.

In yet another aspect, embodiments disclosed herein relate to a method of modifying a drill bit that includes providing a steel bit body having at least one blade and at least one cutter pocket; forming a recess in at least a portion of the surface of the at least one cutter pocket, wherein the recess is adjacent a leading face of the at least one blade; applying an erosion resistant material in the recess; and placing a cutter in the at least one cutter pocket.

Other aspects and advantages of the disclosed embodiments will be apparent from the following description and the appended claims.

DETAILED DESCRIPTION

In one aspect, embodiments disclosed herein relate to protecting the bit body of a steel-bodied drag bit in the area surrounding the cutters. In particular, embodiments disclosed herein relate to a steel-bodied drag bit having such protection, to a method of manufacturing a steel-bodied drag bit with such protection, and to a method of modifying a steel-bodied drag bit to have such protection.

Generally, the embodiments disclosed herein include a steel body having at least one blade; at least one cutter pocket disposed on the at least one blade; at least one cutter disposed in the at least one cutter pocket; at least one recess disposed on at least a portion of the surface of the at least one cutter pocket, where the recess is adjacent a leading face of the at least one blade; and an erosion resistant material in the at least one recess.

As used in reference to the embodiments disclosed herein and the claims, the term cutter is not limited to any specific size, shape, form or material nor is the term cutter limited to cutters created for use in drill bits or other earth drilling applications. As used in reference to the embodiments disclosed herein and the claims, the term erosion resistant material means a material that is more erosion resistant than is the primary material from which the bit body is formed.

Figure 1:
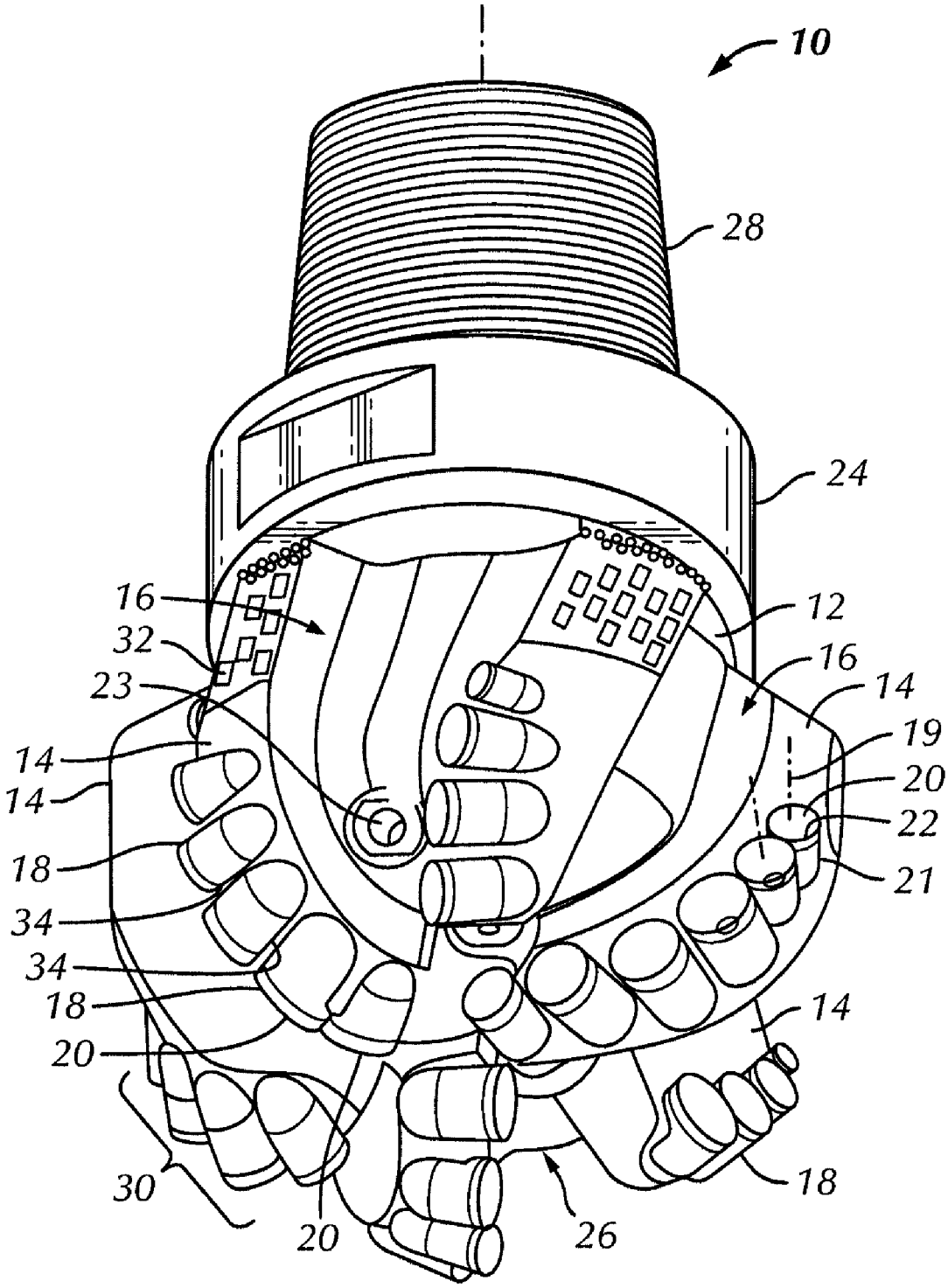
FIG. 1 is a perspective view of a prior art drag drill bit.
Figure 2:
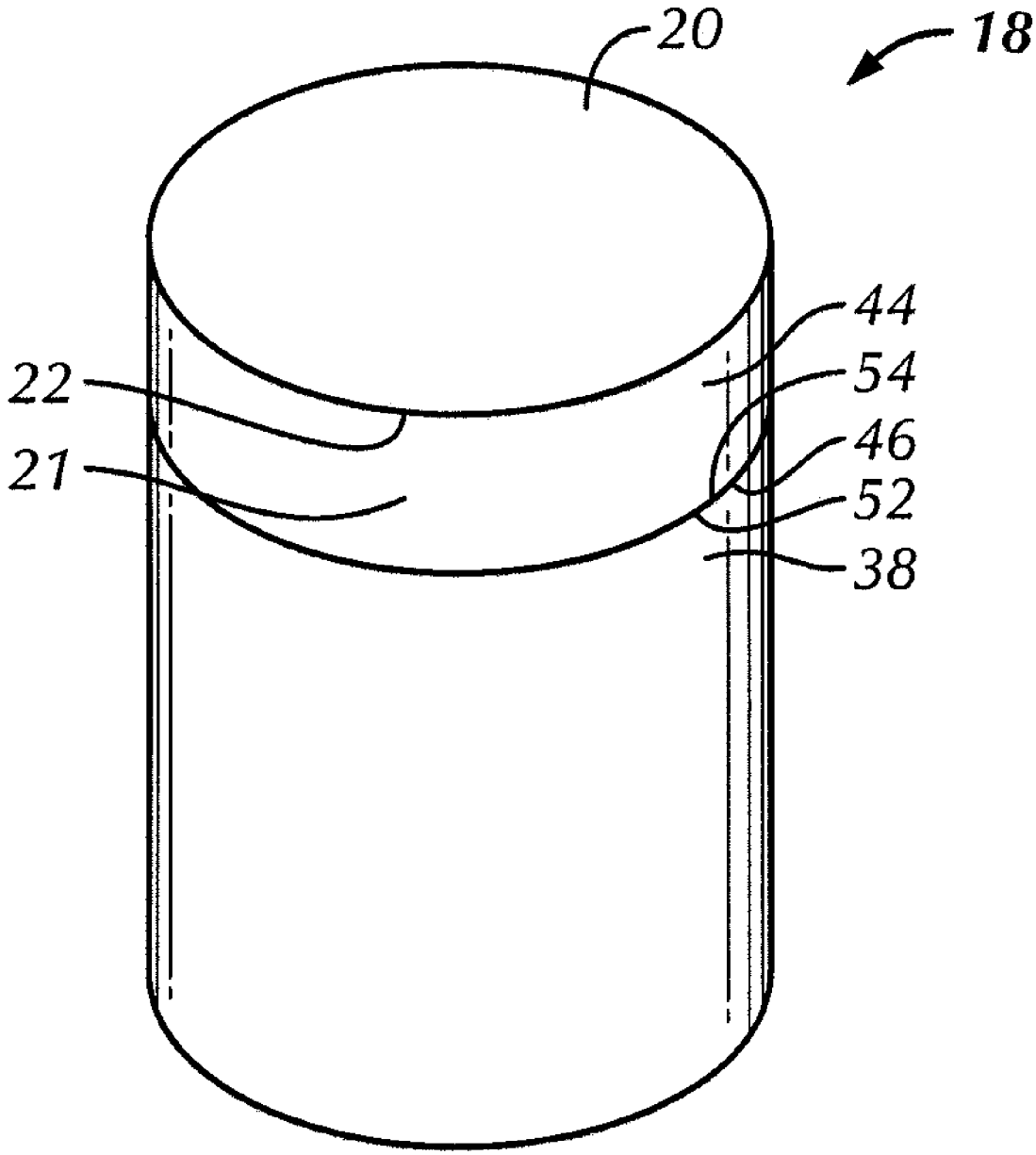
FIG. 2 is a perspective view of a typical cutter.
Figure 3:
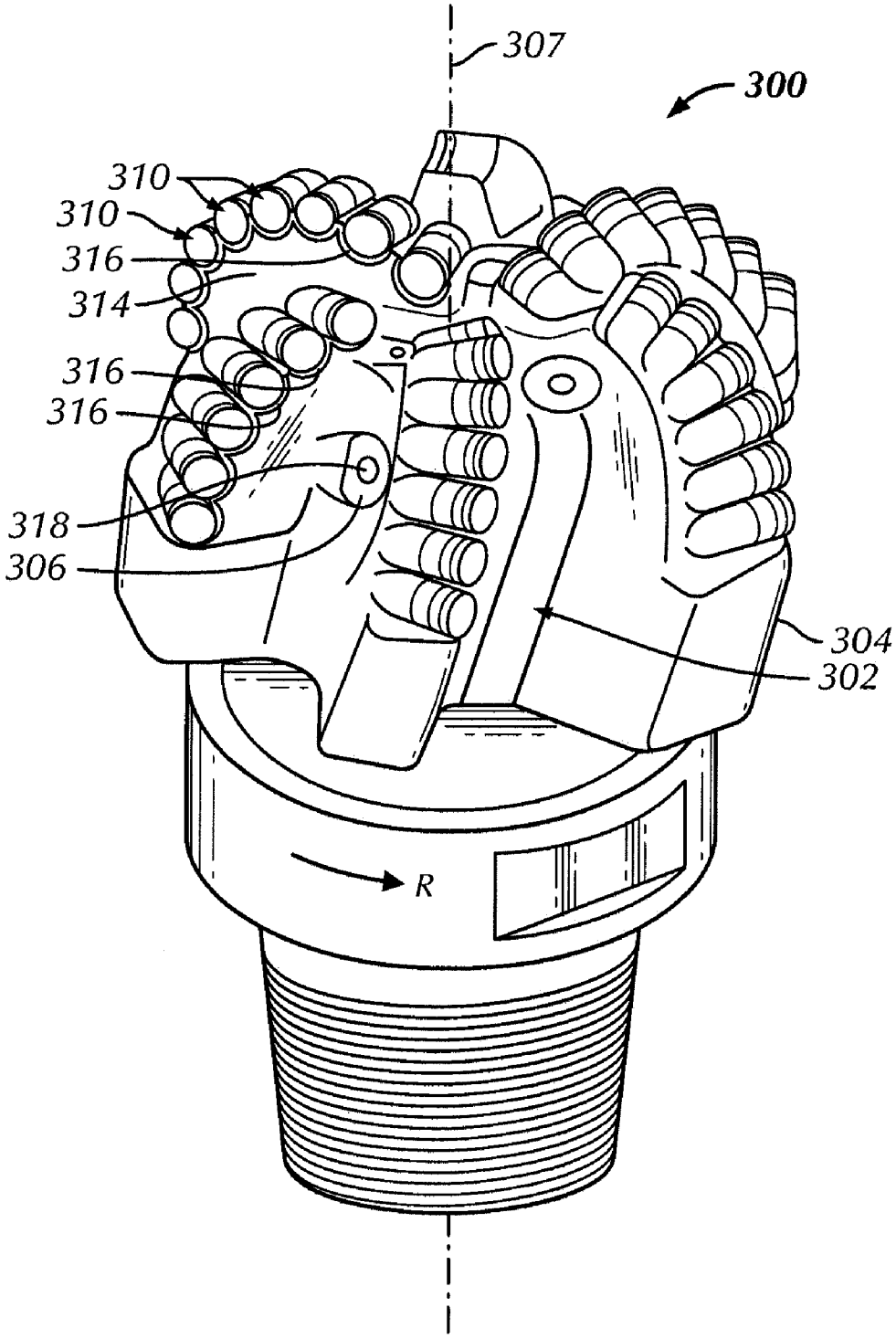
FIG. 3 is a perspective view of a drill bit according to one embodiment.
Figure 4:
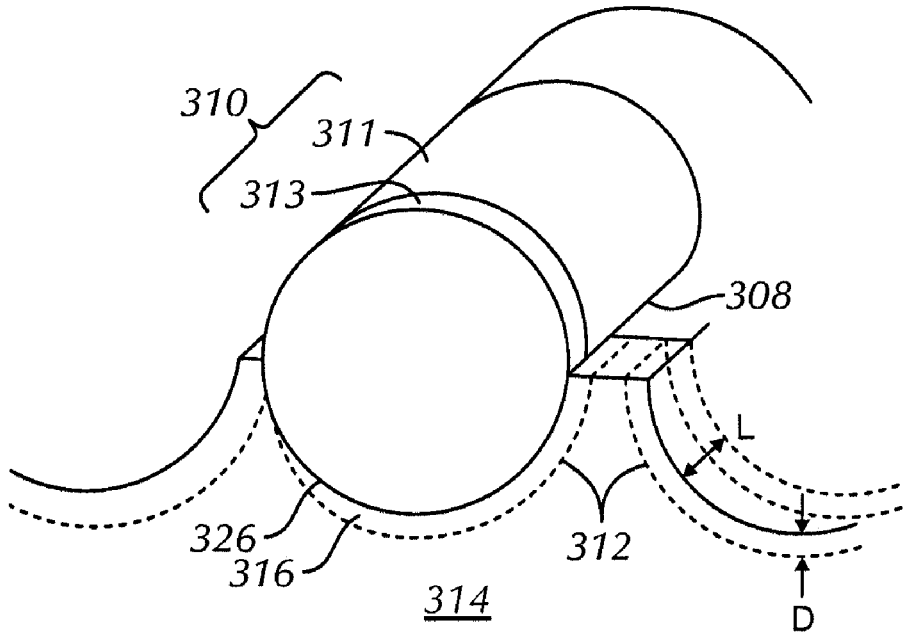
FIG. 4 is a detailed view of a blade of a drill bit according to one embodiment.

Referring to FIGS. 3 and 4, a drill bit in accordance with one embodiment is shown. In this embodiment, the drill bit 300 includes a steel bit body 302 having a plurality of blades 304 and a plurality of orifices 306. The blades 304 generally extend radially from the central axis 307 of the drill bit, and the orifices 306 are positioned on the bit body 302 in the areas between the blades 304. Disposed in the plurality of orifices 306 are nozzles 318, which allow the discharge of drilling fluid. Bit body 302 may optionally include a hardfacing layer (not shown), as known in the art, on any of its surfaces.

As shown in FIGS. 3 and 4, cutter pockets 308 are formed on the tops of the blades 304 and are generally shaped to accept and attach cutters 310 to the bit body 302. The positions of the cutter pockets 308 may be dictated by the desired location of the cutters 310 on the finished bit 300. PDC cutters 310 typically include a cylindrical tungsten carbide substrate 311 with a layer of polycrystalline diamond 313 attached to one end of the substrate 311 and form a cutting edge 326 of the cutter 310. In the embodiment shown in FIGS. 3 and 4, the cutters 310 are positioned on the blade 304 so that the cutter edge 326 is substantially aligned with the leading face 314 (in the direction of rotation of bit 300) of the blade 304. The cutters 310 are typically attached to the bit body 300 by various methods known in the art including, for example, brazing, adhesives, mechanical lock, threads, interference fit, or any other suitable method, or combination of methods. Formed in the surface of the cutter pockets 308 adjacent the leading faces 314 of blades 304 are recesses 312. An erosion resistant material 316 occupies the volume defined by recesses 312.

Steel bit bodies, such as those disclosed herein, may be formed in a machining process by a computer numerically controlled ("CNC") lathe and mill, as known in the art. In this process, a steel bar may be turned to form the general profile of the bit; a drilling operation may form the orifices, cutter pockets, and recesses in the cutter pockets; and the blades and blade tops may be formed by milling. Alternatively, other embodiments may include a steel bit body formed by casting or any other suitable method. Further, one of ordinary skill in the art would recognize that the bit body characteristics such as the number and shape of the blades, the number and shape of the cutter pockets, and the number and placement of the orifices may be varied without departing from the scope of embodiments disclosed herein. The bit body characteristics shown in the illustrated embodiments are for illustrative purposes only and are not intended to limit the scope of the invention.

In one embodiment, the recesses formed in the cutter pockets may be substantially concentric or coaxial with the cutter pocket in which they are formed. Alternatively, the recesses may be eccentric with respect to the cutter pocket in which they are formed. As described above, such recesses may be formed by a drilling operation at substantially the same time as the drilling of the cutter pockets in a machining process. Alternatively, such recesses may be formed by a milling operation performed subsequent to the time that the cutter pockets are formed. In various other embodiments, the recesses may be formed by various other processes known in the art including, for example, grinding, a shot peen, or a deburr tool.

Further, other embodiments may have recesses with different geometry and/or formed by different processes which may be performed at various stages of the bit manufacturing process. However, one of ordinary skill in the art would recognize that the method of forming the recesses, the geometry of the recesses, and the stage of the bit manufacturing process at which the recesses are formed may depend on the particular method used to form the bit body.

The length of the recesses, shown in FIG. 4 as L and measured from the leading face of the blade and substantially parallel to the axis of the cutter pocket, may range, in one embodiment, from a minimum length that is substantially equivalent to the thickness the cutter diamond table to a maximum length that may be more than one-half of the total length of the cutter. In a particular embodiment, the length of the recess may range from a length equivalent to the thickness of the cutter diamond table to a length about 1.5 times the thickness of the cutter diamond table.

The thickness or depth of the recesses, shown in FIG. 4 as D, may vary, in one embodiment, from a minimum thickness that is substantially equivalent to the minimum thickness of the erosion resistant material that can be applied to a maximum thickness, which may be equivalent to the gap between the cutters. In particular embodiments, the thickness of the recess may be one half or one quarter the length of the gap between two adjacent cutter pockets. Additionally, in various other embodiments, the recesses may have a uniform or non-uniform thickness. For example, in one embodiment, a recess may have non-uniform thickness varying from a maximum thickness, at the center point of the pocket, equivalent to the gap length between adjacent cutter pockets and a minimum thickness, in the gap region between adjacent cutter pocket equivalent to one half of the gap length between the two adjacent cutter pockets. One of skill in the art would recognize that the particular length/depth of the recesses may depend, for example, on the size of the particular bit in which the recesses are formed.

The embodiment shown in FIG. 3 includes a recess and erosion resistant material in each cutter pocket, but other embodiments may include a recess disposed in only a single or multiple, but less than all cutter pockets. Particular embodiments may include recesses and the erosion resistant material therein only in the cutter pockets that are expected to experience significant erosion. One of ordinary skill in the art would recognize that the number and location of the recesses may be varied depending on the intended use of the drill bit.

The erosion resistant material applied in the recesses disclosed herein may include, in various embodiments, one or more hard particles surrounded by a binder material. Hard metals such as oxides, nitrides, borides, carbides of Group IV, V, and VI metals and alloys thereof are examples of hard particles that may be used in the erosion resistant material disclosed herein. In a particular embodiment, the erosion resistant material may include tungsten carbide particles surrounded by a metal binder.

Various types of tungsten carbide may be used in the erosion resistant material, including cast tungsten carbide, macro-crystalline tungsten carbide, cemented tungsten carbide, and carburized tungsten carbide. The types, sizes, and percentages of the various carbide particles may be varied depending on the properties desired for the erosion resistant material in any particular application. Carbide combinations suitable for use in the erosion resistant material may include combinations similar to those in U.S. Pat. Nos. 4,836,307, 5,791,422, 5,921,330, and 6,659,206, which are herein incorporated by reference in their entirety.

In a particular embodiment, an erosion resistant material may have varying amounts of hard particles, with a binder alloy constituting the balance of the erosion resistant material. In some embodiments, the binder alloy may include a steel alloy or Group VIII metals such as Co, Ni, Fe, alloys thereof, or mixtures thereof.

In one embodiment, the erosion resistant material may include about 40 to 65 percent by weight spherical cast tungsten carbide and a balance of a nickel alloy, a Ni—Cr—Si—Fe—B alloy in a particular embodiment.

Many factors may affect the durability of the erosion resistant material. These factors include the chemical composition and physical structure (size, shape, and particle size distribution) of the hard particles, the chemical composition and microstructure of the binder metal or alloy, and the relative proportions of the hard particles to one another and to the binder metal or alloy. Due to the inverse relationship between wear resistance and fracture toughness, higher proportions of hard particles may increase the erosion and wear resistance of the erosion resistant material, while decreasing the fracture toughness of the erosion resistant material and weakening the bonding between the erosion resistant material and the steel bit body. Thus, one of ordinary skill in the art would recognize that by varying the type, size and amount of tungsten carbide particles (and thus also the amount of binder material), an erosion resistant material having the desired material properties for a particular drilling application may be selected.

Application of the erosion resistant material may be achieved by any suitable method known in the art. A welding process, such as arc or gas welding, both of which are well known in the art, may be used, for example, when the erosion resistant material includes tungsten carbide or other hard metals. Among the welding techniques that may be used to apply the erosion resistant material are a thermal spray process, an oxyacetylene welding process (OXY), plasma transferred arc (PTA), an atomic hydrogen welding (ATW), welding via tungsten inert gas (TIG), gas tungsten arc welding (GTAW) or other applicable processes as known by one of ordinary skill in the art.

In one embodiment, the erosion resistant material may be applied in the recesses so that it substantially fills the volume of a recess and is flush with the leading face of the blade. In this embodiment, the application of the erosion resistant material in the recesses may substantially preserve the cutter pocket geometry, and in effect, define the cutter pocket. Alternative embodiments may include recesses partially filled with erosion resistant material or erosion resistant material that completely fills the recesses and protrudes past the leading face of the blade.

In some embodiments, the erosion resistant material may be applied in the recesses before the cutters are placed in the cutter pockets. For example, this may be required in embodiments where the process of applying the erosion resistant material includes high temperature processing which would be detrimental to cutters containing temperature sensitive materials such as polycrystalline diamond or to the brazing material securing the cutters in the cutter pockets. Alternatively, in other embodiments, the cutters may be placed in the cutter pockets before the erosion resistant material is applied in the recesses.

When the erosion resistant material is applied in the recesses before the cutters are placed in the cutter pockets, a displacement, the use of which is well known in the art of drill bit manufacturing, that approximates the cutter geometry may optionally be placed in the cutter pockets. The use of displacements may preserve the cutter pocket geometry while the erosion resistant material is being applied to the recesses. As known in the art, displacements may be formed from any suitable material such as graphite or a ceramic material. After the erosion resistant material has been applied in the recesses, the displacements may be removed from the cutter pockets so that the cutters may be placed and secured in the cutter pockets.

The selection of an erosion resistant material may also depend on factors that are independent of the durability of the erosion resistant material. For example, the desired method of application of the erosion resistant material may limit the choice of erosion resistant materials. The selection of the application method may also depend on other various factors, such as, for example, compatibility with the erosion resistant material and the necessary amount of control over the placement of the erosion resistant material.

Likewise, the order of manufacture of the bit may also limit the choice of erosion resistant materials. If the cutters are to be brazed into the cutter pockets prior to the application of the erosion resistant material into the recesses, then the erosion resistant material, and its method of application, should be selected so as to avoid damage to the cutters or the braze joint. In the embodiment in which the cutter is brazed in the cutter pocket prior to the application of the erosion resistant material, the selection of the erosion resistant material may require that the erosion resistant material have a binder with a melting point lower than that of the braze material.

One of ordinary skill in the art should recognize that the composition of the erosion resistant material, the method of application of the erosion resistant material, and the ordering of steps of manufacturing the bit may be varied as required and should not be limited by the embodiments shown.

Figure 5:
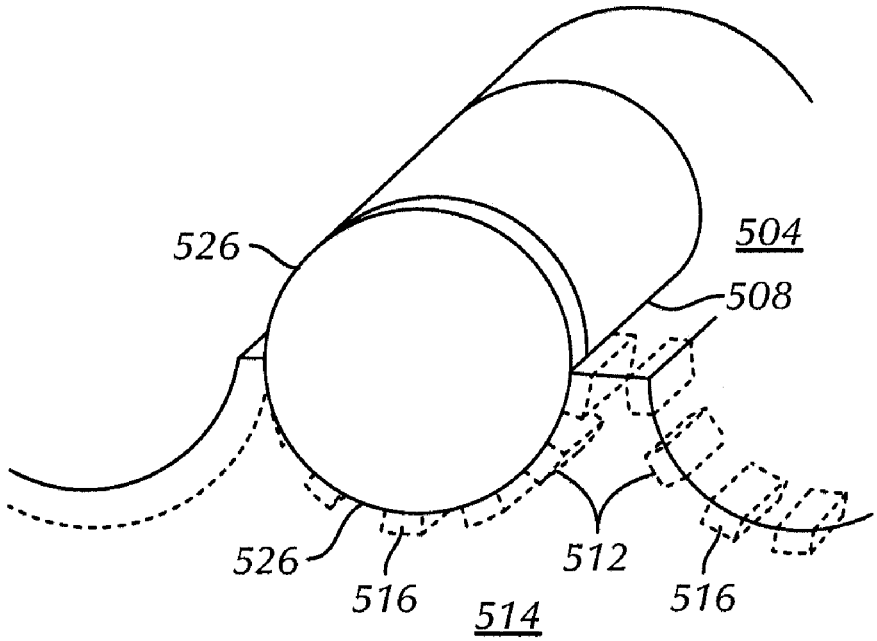
FIG. 5 is a detailed view of a blade of a drill bit according to one embodiment.

Additionally, while the present disclosure may make reference to exemplary lengths/depths/shapes of a recess in a cutter pocket of the present disclosure, one of ordinary skill in the art should recognize that such references have no limitation on the scope of the embodiments disclosed herein. Thus, it is expressly within the scope of the present disclosure that the recess disclosed herein may have any shape or size disposed in the cutter pocket of a steel bit body. For example, referring to FIG. 5, yet another embodiment of recesses of the present disclosure is shown. In FIG. 5, cutter pockets 508 are formed on the tops of the blades 504 and are generally shaped to accept and attach cutters 510 to the bit body (not shown separately). Formed in the surface of the cutter pockets 508 adjacent the leading faces 514 of blades 504 are a plurality of recesses 512. As shown in FIG. 5, each cutter pocket 508 includes a plurality of short axial recesses 512 formed therein. An erosion resistant material 516 occupies the volume defined by recesses 512.

Additionally, as shown in FIG. 3, the drill bit may have a plurality of orifices adapted to accelerate drilling fluid through the bit body. The design and manufacture of bits that include orifices adapted to accelerate drilling fluid is well known in the art. The orifices may be formed in the bit body, with a drilling operation, and subsequently threaded to accept a nozzle. Alternatively, nozzles may be brazed into the bit body, integrally formed with the bit body, or formed or attached by any other suitable method. In a particular embodiment, one or more orifices in the bit body may be positioned so that the drilling fluid impinges upon one or more cutter or upon the erosion resistant material. Adaptation of the orifices of a bit to accelerate drilling fluid in a particular direction is well known in the art. A drill bit designer may determine an optimal direction for the flow of drilling fluid from each of the one or more orifices. The designer may then place and orient the one or more orifices and/or one or more nozzles based on the desired target of the flow of the drilling fluid. Depending on the drilling application, it may be optimal for the flow of drilling fluid to be aimed at the earth formation, indirectly at the cutters, or directly at the cutters.

Embodiments disclosed herein may include one or more of the following advantages. A steel-bodied bit having erosion resistant material in the area surrounding the cutter pockets may be less susceptible to erosion of the bit body around the cutters than a conventional bit. Increased protection against erosion of the bit body may result in fewer lost cutters and fewer bit failures due to lost cutters. The increased protection may also make it more economical to rebuild steel-bodied bits. Reducing erosion in this area may also reduce the number of damaged bit features and the extent of the damage. Thus, minimizing the damage may reduce the amount of time required to rebuild bits, and therefore, make it more economical to rebuild bits.

Further, restrictions on the positioning and orientation of the orifices directing the flow of drilling fluid may also be lessened with increased protection against erosion. With increased erosion resistance near the cutters, orifices aiming drilling fluid directly or indirectly at the cutters may be less likely to erode the bit body around the cutters.

Aligning the leading face of the blade with the cutter edge which is adjacent the leading face of the blade may prevent drilling fluid flow patterns that promote erosion of the bit body around the cutters. The alignment may allow the drilling fluid to flow from the fluid courses and across the face of the cutter without an overhanging cutter edge deflecting the drilling fluid into the joint between the cutter and the bit body.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A drill bit comprising:

a steel bit body having at least one blade thereon;

at least one cutter pocket disposed on a surface of the at least one blade;

at least one cutter disposed in the at least one cutter pocket;

at least one recess formed along an intersection between the at least one cutter pocket and an outer surface of the at least one blade; and an erosion resistant material disposed in the at least one recess.

2. The drill bit of claim 1, wherein the outer surface of the at least one blade is at a top surface of the at least one blade.

3. The drill bit of claim 1, wherein the at least one recess is disposed along at least a length of the at least one cutter pocket.

4. The drill bit of claim 1, wherein the erosion resistant material comprises tungsten carbide.

5. The drill bit of claim 1, wherein the erosion resistant material comprises a transition metal selected from Ni, Co, Fe, and alloys thereof.

6. The drill bit of claim 1, wherein the at least one cutter disposed in the at least one cutter pocket is attached by brazing.

7. A drill bit comprising:

a steel bit body having at least one blade thereon;

at least one cutter pocket disposed on a surface of the at least one blade;

at least one cutter disposed in the at least one cutter pocket;

at least one recess formed in an interior portion of the surface of the at least one cutter pocket extending along at least a length of the at least one cutter pocket; and an erosion resistant material disposed in the at least one recess.

8. The drill bit of claim 7, wherein the at least one recess extends along the entire length of the at least one cutter pocket.

9. The drill bit of claim 7, wherein the erosion resistant material comprises tungsten carbide.

10. The drill bit of claim 7, wherein the erosion resistant material comprises a transition metal selected from Ni, Co, Fe, and alloys thereof.

11. The drill bit of claim 7, wherein the at least one cutter disposed in the at least one cutter pocket is attached by brazing.

12. A method of manufacturing a drill bit comprising:

forming a steel bit body having at least one blade and at least one cutter pocket;

forming at least one recess along an intersection between the at least one cutter pocket and an outer surface of the at least one blade;

applying an erosion resistant material in the at least one recess; and placing a cutter in the at least one cutter pocket.

13. The method of claim 12, wherein the outer surface of the at least one blade is at a top surface of the at least one blade.

14. The method of claim 12, wherein the erosion resistant material is applied in the at least one recess before the cutter is placed in the at least one cutter pocket.

15. The method of claim 14, further comprising:

placing at least one displacement in the at least one cutter pocket prior to applying the erosion resistant material in the at least one recess.

16. The drill bit of claim 12, wherein the at least one recess extends along at least a length of the at least one cutter pocket.

17. The drill bit of claim 16, wherein the at least one recess extends along the entire length of the at least one cutter pocket.

18. The method of claim 12, wherein the erosion resistant material is applied in the at least one recess after the cutter is placed in the at least one cutter pocket.

19. The method of claim 12, wherein the at least one recess is formed by machining.

20. The method of claim 12, wherein placing the cutter comprises a brazing process.

21. The method of claim 12, wherein the erosion resistant material comprises a transition metal selected from Ni, Co, Fe, and alloys thereof.

22. The method of claim 12, wherein the erosion resistant material comprises tungsten carbide.

23. The method of claim 12, wherein the steel bit body and the at least one recess are formed at substantially the same time.

* * * * *